US008440946B2

(12) United States Patent
Kyle

(10) Patent No.: US 8,440,946 B2
(45) Date of Patent: May 14, 2013

(54) SYSTEM USING A JET MILL IN COMBINATION WITH A MICROWAVE SYSTEM TO ECONOMICALLY PREPARE CLEAN COAL FOR USE IN POWER GENERATION

(75) Inventor: Ronald Kyle, Akron, OH (US)

(73) Assignee: Hybrid Electric Conversion Co., LLC, Miami, FL (US)

( * ) Notice: Subject to any disclaimer, the term of this patent is extended or adjusted under 35 U.S.C. 154(b) by 185 days.

(21) Appl. No.: 12/837,091

(22) Filed: Jul. 15, 2010

(65) Prior Publication Data

US 2011/0011853 A1 Jan. 20, 2011

Related U.S. Application Data

(60) Provisional application No. 61/225,822, filed on Jul. 15, 2009, provisional application No. 61/250,961, filed on Oct. 13, 2009.

(51) Int. Cl.
*H05B 6/64* (2006.01)

(52) U.S. Cl.
USPC ..... 219/678; 219/759

(58) Field of Classification Search ..... 219/678, 219/679, 686, 689, 756, 759, 761, 762
See application file for complete search history.

(56) References Cited

U.S. PATENT DOCUMENTS 4,259,560 A * 3/1981 Rhodes ..... 219/678
2008/0245906 A1 * 10/2008 Kerns et al. ..... 241/24.31

* cited by examiner

*Primary Examiner* — Hoai V Pham
(74) *Attorney, Agent, or Firm* — Gifford, Krass, Sprinkle, Anderson & Citkowski, P.C.

(57) ABSTRACT

Coal is processed to produce relatively pure carbon particles of small size by first subjecting mined coal fragments to microwave energy to vaporize the water, mercury, sulfur, and like contaminants and to increase the friability of the coal. Next the fragments are pulverized and then reduced in a jet mill to produce particles of small maximum size and fine particles having an average size of about 20 microns, for use in a power plant or as a fuel for a turbine or diesel engine.

2 Claims, 1 Drawing Sheet

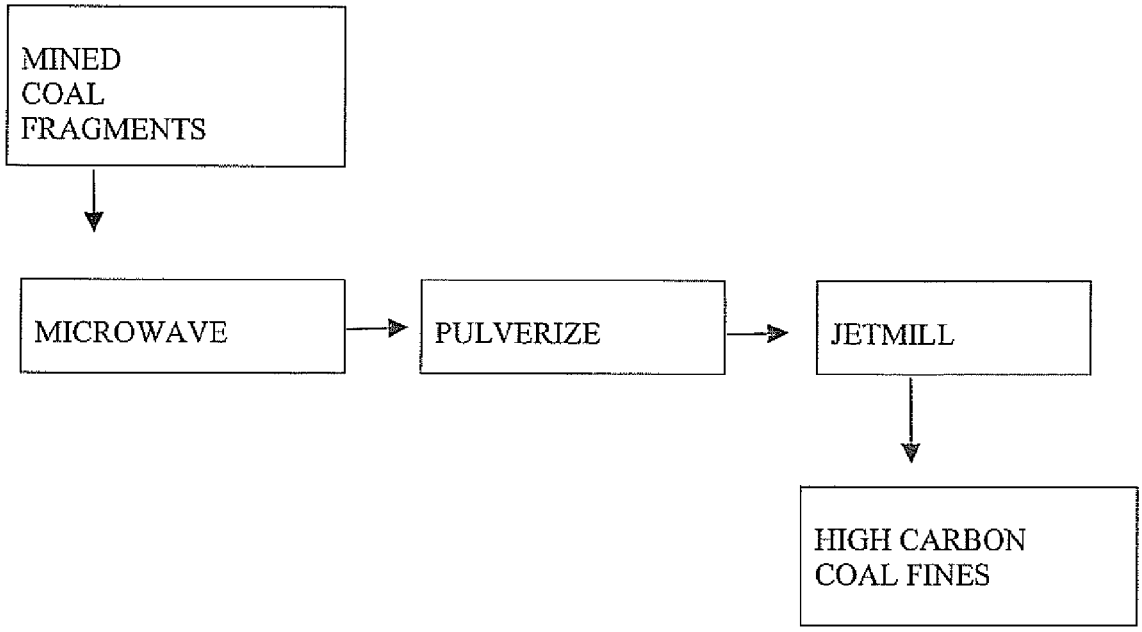
MINED
COAL
FRAGMENTS
MICROWAVE
PULVERIZE
JETMILL
HIGH CARBON
COAL FINES

SYSTEM USING A JET MILL IN COMBINATION WITH A MICROWAVE SYSTEM TO ECONOMICALLY PREPARE CLEAN COAL FOR USE IN POWER GENERATION

CROSS-REFERENCE TO RELATED APPLICATION

This application claims priority of U.S. Provisional Patent Application Ser. No. 61/225,822 filed Jul. 15, 2009, and Ser. No. 61/250,961 filed Oct. 13, 2009, which are incorporated herein by reference.

FIELD OF THE INVENTION

This invention relates to a system and method for processing coal to remove contaminants and reduce the coal fragments in size and more particularly to such a system and method employing microwave radiation, pulverization and jet milling.

BACKGROUND OF THE INVENTION

Traditional coal sources are relatively high in sulfur. For example, Ohio coal is "dirty" and typically contains about 3.5% sulfur, and its use has been significantly limited by The Clean Air Act Amendments of 1990 (the "CAAA"). This limitation has resulted in a significant reduction in the use of these traditional coals from the Appalachian area, Illinois basin, Ohio, Kentucky, etc. There has been a movement by the electric power plants in these areas to replace the high-sulfur local coals with Powder River Basin (PRB) coal which typically contains about 0.3% sulfur. The heating value of PRB coal is significantly lower and the cost of transporting it by rail to the areas of use in these Eastern and mid-Western states is expensive.

Therefore, there is a vast amount of coal that is not being utilized due to its high sulfur content. For example, according to the Department of Energy, Ohio mines about 28 million tons of coal annually and consumes 60 million tons annually for its domestic electric power generating needs. Ohio is ranked third in the nation for its coal consumption for electric power generation. Replacing coals like the PRB coal with "clean-burning" Ohio coal could double the current size of the industry back to the levels of the 1970s, when Ohio produced about 55 million tons per year. According to the United States Geological Survey, Ohio's demonstrated coal reserves currently about 24 billion tons.

There are numerous coal-fired electric power generating plants in the Eastern and mid-Western states that, like the Ohio plants, have had to switch a portion of their coal supplies to PRB coal or other coal with lower sulfur content in order to meet the requirements of the CAAA. In addition, the limits on sulfur emissions are becoming more difficult and more expensive to meet.

SUMMARY OF THE INVENTION

The present invention uses a jet mill process with the microwave system enhancement to provide "clean-burning" coal that can be used for current and future electric power plants or as an engine fuel.

The objective for this invention is to produce a clean-burning coal by reducing the sulfur and other contaminants in the coal, especially heavy materials such as mercury, metals, etc. and by increasing the efficiency of combustion of the coal by reducing its particle size and increasing its surface area.

Microcoal Inc. has demonstrated in laboratory and pilot plant trials that its microwave treatment of coal can reduce the sulfur content of these traditional coals to levels that will achieve the requirements of the CAAA. MicroCoal notes that its proprietary process cleans up coal by reducing contaminates like sulfur and mercury. MicroCoal also notes that the unique characteristics of microwave energy alters the physical properties of coals driving out moisture, volatilizing contaminants, and rendering the coal suitable for further clean-up by other electro-mechanical process steps.

This microwave process also improves the combustion efficiency of the coal by removing the moisture, including the "bound moisture," contained in the coal and increasing its surface area. Bound moisture is that moisture, which is trapped inside a material and is not easily removed by conventional drying methods such as convection ovens. Microwave emitters have proved to be effective at driving this moisture to and through the surface for solids similar to coal and oil shale.

The microwave process is more efficient and can be completed faster when the coal is reduced to very small particles. Therefore, using a jet mill to reduce the particle size and increase the surface area of the coal can greatly enhance the removal of sulfur and other unwanted materials. As noted above in the oil shale proposal, when microwave power is directed at coal it can increase the surface area of the treated coal by up to 400%, further enhancing the removal of these undesirable materials and improving its combustion efficiency.

The coal will be mined and pulverized using current conventional equipment and future equipment to reduce the coal to the sizes that are the most efficient for the jet milling process. The jet mill(s) will then further reduce the particle size of the coal to the level that provides for the most efficient removal of the sulfur and other contaminants. Currently, coal typically is reduced in size to about 200 mesh (74 microns) before it is sent to the burner and it could easily be presented to the jet mill at that same 200 mesh size or other reasonable size depending on the application and designer preference.

Since the microwave power makes the coal easier to fracture, a size range for the coal feed to the jet mill might be somewhere between 100 mesh (149 microns) and 300 mesh (49 microns) or other reasonable size depending on the application and designer preference. The jet mill can readily reduce the size of the coal to between 5 microns and 40 microns or other reasonable size. These sizes for the coal being fed from the pulverizer to the jet mill and the coal being discharged from the jet mill for combustion will be developed to provide for the most economical and efficient operation. Laboratory and pilot tests on coal treated with microwave power show that it is reasonable to expect a reduction in its resistance to grinding of about 20% to 40% depending on the coal.

Another advantage of this process is that, as the particle size of the coal being fed to the burner is reduced and its surface area is greatly increased, the combustion efficiency increases and the $NO_x$ and particulate emissions in the flue gases are lowered. Therefore, reducing the particle size to 10 microns, or even lower, could be economical from the standpoint of lower emissions, reduced ash, reduced slag, reduced particulate, lower carbon dioxide production, and coal savings. As noted above in the oil shale proposal, this lower particle size and microwave power provides for a huge increase in surface area, which can significantly enhance the combustion efficiency and reduce these undesirable products of combustion.

This small particle size, high surface area, clean-burning coal also would be suitable for adapting current and future forced coal and air injection technologies into currently operating power generation plants. Based on testing done by the Central Research Institute of the Electric Power Industry in Japan, Foster Wheeler Power Group, and other parties, this combustion technology could significantly reduce or eliminate ash and slag and further improve the combustion efficiency, increasing the benefits listed above.

In addition, as the coal particles are reduced in size its physical properties become more similar to that of a gas when it is fed to the burner. In previous experiments by the Fluid Energy Processing and Equipment Company (formerly Fluid Energy Abet), Florida Power and Light, and the US Department of Energy, small particle coal was burned successfully in combination with fuel oil suggesting that it also can be burned in combination with natural gas or other gaseous and liquid fuels.

The jet mill can be readily modified for the addition of the microwave equipment and its operation. When using microwave power, ceramic linings or other suitable materials for the jet mill may be necessary. Today's ceramic linings are fully dense and very hard, with long wear life and allow little, if any, contamination of the product being ground.

While the addition of the microwave power to the coal in the jet mill is preferred and is expected to gain the most advantages for the process, another option would be to modify the process to provide microwave power to the coal immediately prior to feeding it into the jet mill. It is expected that most of the benefits described above for the addition of microwave power to the coal could be achieved when the microwave system is installed at this location. However, microwave power could be added at other reasonable locations depending on the application and designer preference. For example, it may be economical to also treat the coal with microwave power prior to or during the conventional pulverization process, in order to lower the power and time required to pulverize the coal to a certain particle size, before it is sent to the jet mill.

Jet milling of the coal without the addition of the microwave power can be used to reduce the sulfur and other contaminants and to attain the benefits of small particle coal. Based on MicroCoal's proprietary process, the microwave process also can be used separately to reduce the sulfur and other contaminants and to reduce the power and time required for pulverization. However, when used in combination, these two processes will be synergistic.

As it does for oil shale, the microwave treatment of coal enhances the benefits by reducing the grinding power and time to achieve a certain size reduction. For coal the use of the microwave treatment is enhanced by adding the ability to reduce the coal size to 10 microns or less more economically. These processes in combination will provide a much cleaner coal that can be burned with significantly greater combustion efficiency and significantly lower emissions than can be achieved for either process used separately.

Microwaving the coal improves its cleaning characteristics and further increasing the surface area of the materials by jet milling is expected to enhance those improvements. The resultant very high surface area of the coal makes it much easier to remove the impurities using the centrifugal forces in the jet mill and further reductions can be achieved by magnetic separation, floatation, reverse floatation, and other beneficiation processes. Coal treated in this manner can be very clean, with very low impurities. At the same time the clean coal can be reduced to the optimum size to transport to the burner and to provide for the most efficient combustion.

As for the oil shale and oil sands, the water usage is minimal. The superheated steam can be recycled with about 95% of the water being recovered. In many cases this water will be made up from the moisture content of the coal, which will be recovered in the process. For some sub-bituminous coals such as the PRB coal, moisture in the coal will provide an excess of water. So this process is suitable even for areas with limited access to water.

Another option is to use compressed air or another suitable gas at a suitable pressure as the propellant. The microwave power can be used to provide the heat needed to efficiently extract and clean the coal. In this case, no water would be required for the process and most of the moisture contained in the coal would be recovered and used on site or returned to local streams, rivers, etc.

For this application, the coal; any hydrocarbon gases released from the heating of the coal; water vapor from the moisture in the coal; minerals from the coal, mostly clay and silica; water; heavy metals; and other materials can be separated in the jet mill. The heavier liquids, solids, and gases can be separated in layers by centrifugal force and removed from the flow by vanes and ports on the jet mill in locations that provide for the most effective and efficient separation as noted above in the oil shale proposal.

In addition, any post process resultant co-product materials from the jet milling process, especially the calcium carbonate and silicates, if necessary, could be readily upgraded so that they would be more valuable for commercial applications and could increase the overall efficiency and lower the net cost of the jet milling process.

This process can remove a significant portion of the water, sulfur, mercury, heavy metals, iron, ash, and other minerals from the coal. The sulfur removal can be enhanced by thermally decomposing the pyrite to pyrrhotite, which is more magnetic and can be easily extracted from the coal. The resultant small particle "clean coal" can be sent to the burner or may be used as a fuel in a turbine or diesel engine, alone or in a slurry.

This jet milling and microwaving of the coal is likely to be done at each power plant location adjacent to the burner. However, the coal could be cleaned and reduced in size at the mine, or other central location, properly stored, and loaded into rail hopper cars for transport to the power plants for use. Precautions would be necessary to prevent spontaneous combustion during storage and transport as are currently required for most small particle products.

Small particle size coal potentially could be transported by pipeline. In the event the coal were to be cleaned and reduced in size at a mine or central site, it could be transported by pipeline to the end use locations. The treatment site could be some distance from the burner and the coal could be transported to the burner via pipeline. If desired, this pipeline transport could be done in combination with a liquid or gas. Past experiments by Fluid Energy Processing and Equipment Company (formerly Fluid Energy Aljet), Florida Power and Light, and the US Department of Energy, have confirmed that a 45% milled small particle coal blend with fuel oil stayed in suspension with the oil during storage and transport.

Combine jet milling and microwave power to produce "clean-burning" coal for current and future electric power generation.

Microwaving the coal makes it easier to remove the impurities and further increasing the surface area of the coal by jet milling will significantly enhance those improvements.

Increasing the surface area makes it much easier to separate the coal from the impurities by centrifugal force and also enhances any further cleaning by other reasonable means such as magnetic separation, floatation, reverse floatation, and other beneficiation processes. Coal treated in this manner can be made very clean, with very low impurities. The clean coal can be reduced to the optimum size to transport to the burner and to provide for the most efficient combustion.

Most of the water can be removed from the coal and used on site or returned to the local streams, rivers, etc. No additional water is likely to be required for any part of the process. The final moisture content will be a function of optimizing the energy costs, boiler requirements and emission standards. The final increment of water can be removed from the coal in the jet mill separation system.

At least 50% of the sulfur can be removed from the coal. Pyrite is very susceptible to microwave radiation and in the process will release elemental sulfur that can be seen by the naked eye. As more pyrite is converted to pyrrhotite during the process, its magnetic properties are greatly enhanced and nearly all of the pyrite can be removed from the coal by separation in the jet mill or by magnetic separation.

At least 70% of the mercury can be removed from the coal. Mercury in the form of cinnabar (HgS) is associated with pyrite, and so it undergoes the same removal process and it is expected that most of mercury also can be removed.

At least 50% or more of the calcium carbonate, silica, and other minerals can be removed from the coal and can either be sold for specific uses such as wallboard, concrete, etc. or used in land reclamation. Using the jet milling separation process combined with the microwave power could remove 70% or more of these materials.

BRIEF DESCRIPTION OF THE DRAWINGS

FIG. 1 is a block diagram illustrating a preferred embodiment of my invention.

DETAILED DESCRIPTION OF A PREFERRED EMBODIMENT OF THE PRESENT INVENTION

Microwaving the coal prior to pulverizing reduces the power and/or time required for pulverizing by 20% to 40% for a certain coal. The conditions of this operation would be set to the preferred level for pulverizer power reduction. During this process approximately 40% of the sulfur, 60% of the mercury, and 40% of the ash can be removed, depending on the conditions.

The coal from the pulverizer will be fed to a jet mill that is equipped with microwave power and uses compressed air for the propellant. It is estimated that compared to the original coal approximately 75% of the sulfur, 85% of the mercury, and 70% of the ash will be removed, depending on the conditions. The moisture can be removed to the most economical level. The coal size can be reduced to the most reasonable size for efficient and clean burning, to reduce $NO_x$ and $CO_2$.

The process can be refined to further clean the coal depending on economics and preference. The suggested process is for example only and many other variations can be used depending on the installed equipment, coal source, desired outcome, economics, and operator preference.

Coal Fines:

Coal fines can be reclaimed by this jet mill and microwave system. Coal fines are defined as coal with a maximum particle size usually less than one-sixteenth inch and rarely above one-eighth inch. Analyses of these fines show that a significant portion of the fines can range in particle size down to 30 microns and some to 10 microns or even less. Typically the high moisture content of fine coal waste, or coal fines, has forced coal producers to discard the waste in storage areas called waste impoundments.

Estimates indicate that these impoundments nationwide hold about 2 billion tons of fine coal in abandoned ponds and an additional 0.5 billion to 1 billion tons in active ponds. In 2007 the US consumed 1.13 billion tons of coal, so this represents almost 3 years supply. The EPA notes that this very fine coal that has been stored in ponds is a serious problem of containment and land use. These coal fines usually have a relatively high sulfur content that can leach into the ground water. These coal fines also contain high levels of ash (clays and other inorganic materials), and these ash levels are often over 30% by weight. These coal fines typically are reported to be too wet and too fine to be reasonably handled and fed into the combustor.

There are several methods that have been proposed and tested for the removal of the ash and free water from these fines. After the ash and free water are removed, the jet mill process with the microwave enhancement can be used to reclaim the coal from these coal fines. This jet mill and microwave system can readily dry the coal, reduce its sulfur content, remove a portion of any remaining ash, and grind the coal to a common size all in one operation. For example, these coal fines, using this process, can be reduced in size to about 10 microns, 5 microns, or other reasonable size and used as described above. This reclamation process could be done at the point of use, at the impoundment, or other reasonable locations.

Another option could be to feed the coal fines with the ash into the jet mill and microwave system. The jet mill and microwave system could be used to dry the coal fines and the jet mill classification zone could be designed to separate the ash from the coal and/or a separate classification system could be added. As noted above, Sturtevant and Fluid Energy Processing and Equipment Company note that their air classifiers balance the physical principles of centrifugal force, drag force, and gravity to generate a high-precision method for classifying particles according to size or density. They note that for dry materials of 100 mesh and smaller, typically air classification provides the most effective and efficient means for separating a product from a feed stream. After the ash is removed, the coal then could continue to be processed in the jet mill and microwave system, and/or an additional jet mill and microwave system, as described above.

Combining the Jet Mill Functions with the Pulverizer:

An option to the pulverization and separation of these materials is to add/combine the jet mill functions of ultra fine particle grinding and the separation of the components in the coal, oil shale, and oil sands to the pulverizer, especially the jet mill air classification zone. These air classifiers balance the physical principles of centrifugal force, drag force, and gravity to generate a high-precision method for classifying particles according to size or density.

For example as the ground material exits the pulverizer it would be delivered to tangential air jet nozzles that could be located at or near the bottom dead center of the pulverizer rotor or another reasonable location and be injected into a vertical jet mill section of the vulcanizer. The jet mill could further grind the material and an air classification system to separate the components. If desirable, microwave power could also be added to this jet mill and/or air classification equipment.

Having thus described my invention, I claim:

1. A process for operating on mined coal fragments to remove contaminants and produce relatively fine particles comprising:

subjecting the mined coal fragments to microwave energy to vaporize the contaminants in the coal fragments and render the mined coal fragments friable;

pulverizing the microwaved coal fragments; and reducing the pulverized coal fragments in a jet mill to produce coal particles of predominantly less than 300 mesh.

2. The process of claim 1 wherein the contaminants comprise water and sulfur.

* * * * *